US005257244A

United States Patent [19]

Thinsen

[11] Patent Number: 5,257,244

[45] Date of Patent: Oct. 26, 1993

[54] MENU DISPLAY OF OPERATING INSTRUCTIONS WITH INDICIA FOR MULTIMODE ELECTRONIC TIMEPIECE

[75] Inventor: Tom Thinsen, Sunnyvale, Calif.

[73] Assignee: Timex Corporation, Middlebury, Conn.

[21] Appl. No.: 866,581

[22] Filed: Apr. 10, 1992

[51] Int. Cl.[5] ..... G04B 45/00; G04B 17/12

[52] U.S. Cl. ..... 368/41; 368/74; 368/185

[58] Field of Search ..... 368/41-44, 368/74-77, 185-198

[56] References Cited

U.S. PATENT DOCUMENTS

| | | | |
|---|---|---|---|
| 4,283,784 | 8/1981 | Horan | 368/87 |
| 4,780,864 | 10/1988 | Houlihan | 368/10 |
| 4,783,773 | 11/1988 | Houlihan et al. | 368/108 |
| 5,140,563 | 8/1992 | Thinesen | 368/70 |

*Primary Examiner*—Bernard Roskoski

*Attorney, Agent, or Firm*—William C. Crutcher; Lise A. Rode

[57] ABSTRACT

A multimode electronic timepiece has a display, a case, a plurality of manually actuated actuators disposed about said case, and an integrated circuit programmed to keep time and to provide a plurality of modes for performing a plurality of timepiece functions, including a first and second modes. The integrated circuit is further programmed to permit an operator to sequentially cycle a timepiece through the plurality of modes by selectively and repetitively actuating a first actuator. The improved timepiece includes a program for the integrated circuit adapted to dispose the timepiece out of a first and second of the plurality of modes into a first and second operating instruction subroutine in response to actuation of a second actuator. The first and second operating instruction subroutine respectively comprise a first and second set of operating instructions which describe the operation of the actuators when the timepiece is respectively disposed in the first and second modes. The first and second operating instruction subroutines are adapted to allow a timepiece operator to cycle the timepiece through the first and second of operating instructions in response to continuous uninterrupted actuation of the second actuator.

8 Claims, 4 Drawing Sheets

MENU DISPLAY OF OPERATING INSTRUCTIONS WITH INDICIA FOR MULTIMODE ELECTRONIC TIMEPIECE

This invention relates generally to multimode electronic timepieces. More particularly, this invention relates to an improved program for displaying on a multimode electronic timepiece display, a plurality of messages and indicia comprising timepiece operating instructions.

Multimode, multifunction wristwatches (or wrist instruments) are known which include a display, a lamp for illuminating the display, a number of manually actuated switches and an integrated circuit programmed in a preselected sequence. Examples of such watches are seen in U.S. Pat. No. 4,783,773-Houlihan et al., U.S. Pat. No. 4,780,864-Houlihan and U.S. Pat. No. 4,283,784-Horan, all of the foregoing being assigned to the present assignee. In the Horan patent, a timepiece is provided with an integrated circuit, including a main random access memory (main RAM), a flag random access memory (flag RAM) and a programmed logic array (PLA), which are efficiently disposed in the timepiece such that a minimum amount of semiconductor chip space is used. The combination of these elements is adapted so as to provide for greater flexibility for operator selection of one of the plurality of timekeeping functions, or modes. In the foregoing Houlihan patents, which are merely exemplary of multimode electronic wrist instruments or multifunction wristwatches, one of the manual actuators may typically serve to repetitively cycle the instrument through a number of modes and operating states in each of which a different type of information is displayed. Such modes may include, in a multifunction watch, the time of day, chronograph, dual time zone countdown timer and so forth. By special preselected actuation of one of the actuators, the wristwatch may be converted into a computer, a speedometer, pulsometer or any other type of device, subject only to the imagination of the designer and programmer of the integrated circuit. While in any of these modes, another manual actuator may be employed to change the information being displayed in that mode's state, such as initiating the chronograph timing or setting the time-of-day, or performing a calculation.

Video cassette recorders (VCR) are known wherein instructions for programming the clock/timer are stored within the memory means of the VCR itself and may be displayed on a video display terminal to which the VCR is electrically connected. For example, some Hitachi and RCA VCR's are adapted to display on said video display terminals, a menu option display comprising available VCR functions. Selection by the viewer of one of the menu options will cause to be displayed on the video display terminal, detailed instructions to guide the viewer in the operation of the VCR.

A problem existing with multimode electronic timepieces is that as the number of functions performable by said timepiece increases, it becomes increasingly difficult for the timepiece operator to recall which timepiece actuators are adapted to perform which timepiece function. Operating manuals which often accompany such timepieces at purchase are often times not readily available, or have been lost. It would therefore be desirable to provide a multimode electronic timepiece with operating instructions to guide the timepiece operator on the operation of the timepiece. However, unlike the aforementioned VCR's, the display elements of the timepiece electrooptic display, and thus the amount of characters/fonts that may be displayed on said display, are limited. Correspondingly, the detailedness of operating instructions for said timepiece is likewise limited.

Accordingly, one object of the present invention is to provide the operator of a multimode electronic timepiece with readily available timepiece operating instructions.

Another object of the present invention is to provide a multimode electronic timepiece which includes a program which is adapted to display on the timepiece display, messages comprising timepiece operating instructions.

A further object of the present invention is to provide a multimode electronic timepiece with a program which is adapted to display on the timepiece display, messages and indicia comprising timepiece operating instructions, said program being further adapted to display said indicia on a portion of said display adjacent to the actuator which is adapted to perform the timepiece function corresponding to said message.

SUMMARY OF THE INVENTION

Briefly stated, the invention comprises an improvement in a multimode electronic timepiece having a display, a case, a plurality of manually actuated actuators disposed about the case, and an integrated circuit programmed to keep time and to provide a plurality of modes for performing a plurality of timepiece functions, including a first and second modes, the integrated circuit being programmed to permit an operator to sequentially cycle said timepiece through the plurality of modes by selectively and repetitively actuating a first of the plurality of said actuators. The improvement comprises a program for the integrated circuit adapted to provide first and second operating instruction subroutines, wherein the program is responsive to selective actuation by a timepiece operator of a second of the plurality of actuators and is further adapted to dispose the timepiece out of the first and second modes respectively into the first and second operating instruction subroutines in response to a first actuation of the second actuator. The first and second operating instruction subroutines respectively comprise first and second sets of operating instructions, wherein the operating instruction subroutines are adapted to allow a timepiece operator to cycle said timepiece through the first and second sets of operating instructions in response to continuous uninterrupted actuation of the second actuator. The operating instruction subroutines are further adapted to display the first and second sets of operating instructions on the timepiece display, and the first and second operating instructions describe the operation of the plurality of actuators when the timepiece is respectively disposed in the first and second mode.

DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawings, in which:

DESCRIPTION OF THE PREFERRED EMBODIMENT

Figure 1:
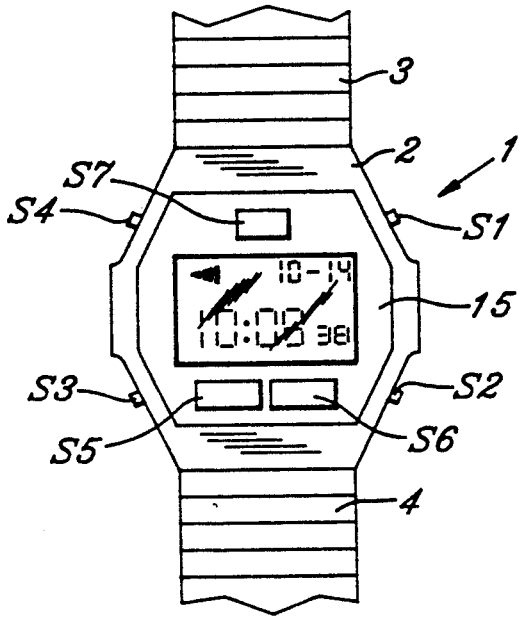
Prior Art Fig. 1
FIG. 1 is a plan view of a multimode electronic wristwatch in simplified form.

Referring now to FIG. 1 of the drawing, a multimode electronic wristwatch 1 includes a case 2 adapted to be held on the wrist by a strap, portions of which are seen at 3 and 4. The wristwatch case includes 7 manual push button actuators S1, S2, S3, S4, S5, S6, S7 disposed about said case 2 and arranged to close spring contacts (not shown), inside the watch case 2. An electrooptic display 15, which is commonly a liquid crystal display (or LCD) includes display fonts and displays digits, letters or other symbols when activated by a microcomputer inside the watch in the form of an integrated circuit.

Figure 2:
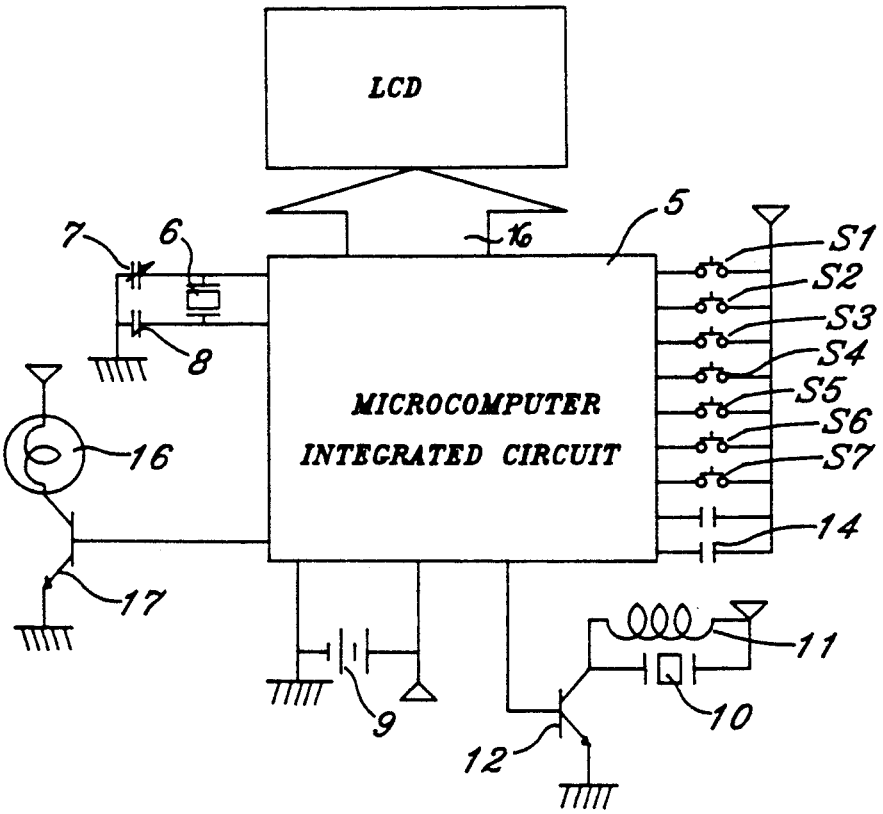
Prior Art Fig. 2
FIG. 2 is a block diagram of a circuit for the wristwatch of FIG. 1, together with external components such as lamp, switches and display.

Referring now to FIG. 2 of the drawing, a schematic block diagram of the electrical connection is shown which is in accordance with conventional multimode electronic watch technology well known to those skilled in the art. A programmable microcomputer 5, in the form of a mask-programmable integrated circuit is bonded to a printed circuit board (not shown) and includes suitable pin connections and leads connected to various external components shown in the diagram which are also mounted on the printed circuit board. The microcomputer includes a microprocessor (including a central processing unit, or CPU), operating system program for carrying out instructions, and memory locations. A quartz crystal 6 connected in circuit with capacitors 7 and 8 and connected to the oscillator pins of the integrated circuit 5 provide a high-frequency time base.

A battery power source 9 is provided in the form of a button type energy cell in the watch case. A watch alarm is made up of a piezoelectric crystal 10, inductance coil 11 and drive transistor 12. Two fixed external capacitors, 13, 14 combined with other circuit elements inside the integrated circuit 5 serve to boost the output voltage to drive the LCD 15 through a display bus 16, which represents the several parallel leads connected to the various actuatable segments of the LCD display 15 (also shown in FIG. 1). Display 15 is arranged in close proximity with, so as to be illuminated by, a lamp 17 when the lamp is lit by a switching signal from integrated circuit 5 applied to the base of switching transistor 18.

Figure 3:
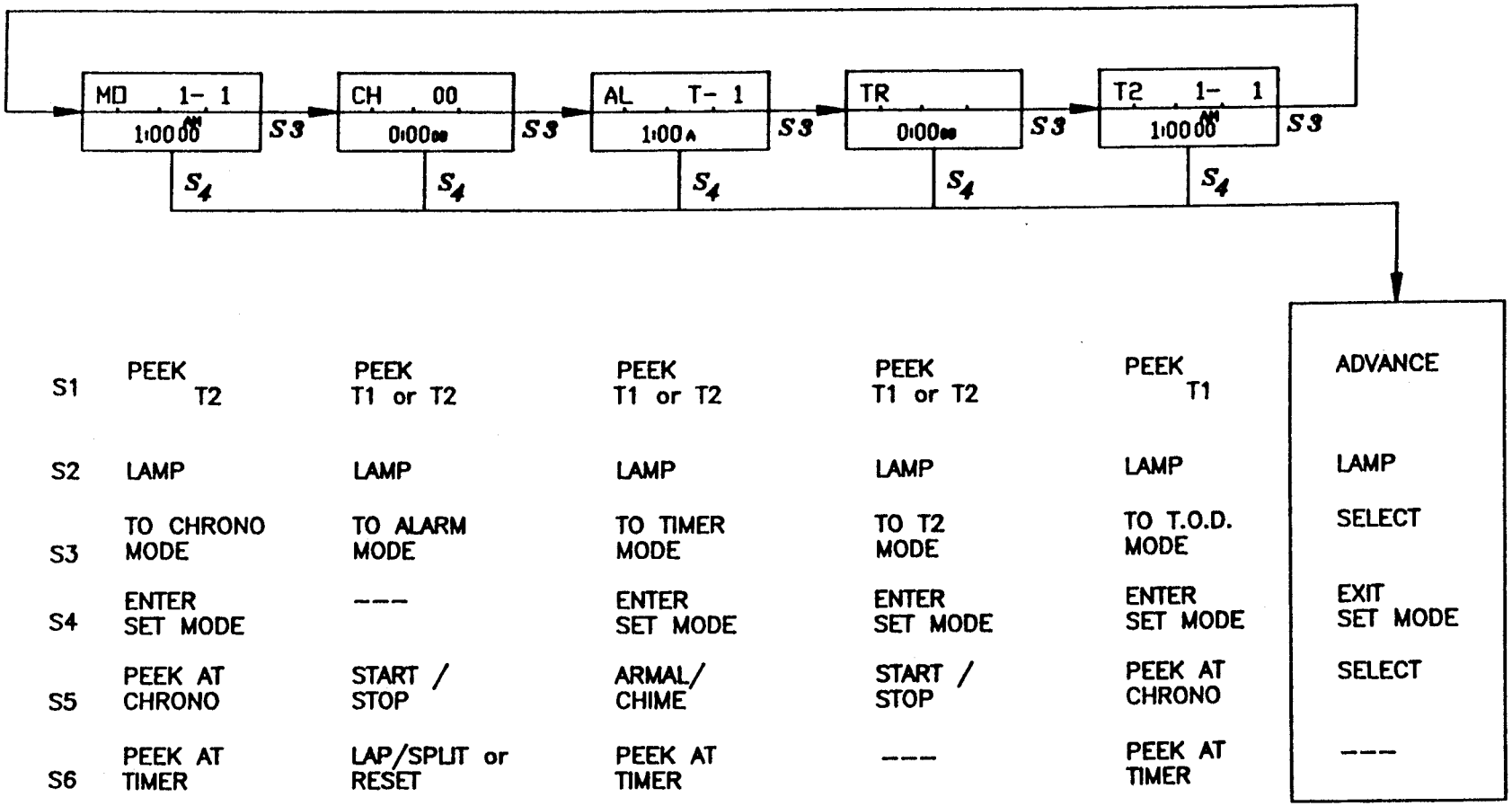
FIG. 3 is a block diagram of a multimode wristwatch illustrating a sequence of modes in response to manually actuated actuators.

Reference to FIG. 3 shows a block diagram of a multimode wristwatch and illustrates the sequence of modes in response to manual actuation switches S1–S7. Each of the blocks illustrates the initial appearance of the timepiece display at the moment the timepiece is first disposed into that particular mode. The modes for this particular timepiece are time-of-day, chronograph (CR), elapsed time (TR), alarm setting (AL), and alternate time zone (T2), although it will be understood that other modes may be substituted or added to said multimode wristwatch. As indicated in FIG. 3, the program is adapted such that repeated actuation of S3 sequentially cycles the timepiece through the aforementioned modes. Once the timepiece is disposed in one of the five modes, actuation of S4 initially initializes a subroutine SET for changing the information displayed, actuation of S3 or S5 selects the particular piece of information to be set (which is indicated on the display by "blinking" the indicia for that selected piece of information), actuation of S1 advances the said selected piece of information, and actuation of S2 cause the wristwatch lamp to be illuminated. Subsequent actuation of S4 while in the SET subroutine causes the timepiece to be disposed out of SET subroutine and returned to the home mode from which SET subroutine was entered.

Actuation of S5 while in time-of-day mode or alternate time zone mode will cause the chronograph mode to be temporarily displayed, said temporary display being coincident with the actuation of S5. Release of S5 will cause the timepiece to be respectively returned to the time-of-day or alternate time zone mode. Actuation of S5 while in the chronograph and timer modes will respectively initiate the chronograph and timer, while a second actuation of S5 will respectively stop the chronograph and timer. Repeated actuation of S5 while in these modes will alternately start and stop the chronograph and timer. Finally, actuation of S5 while in the alarm setting mode will arm the alarm.

If the timepiece operator actuates S6 when the timepiece is disposed in the time-of-day, alarm setting, and alternate time zone modes, the timer mode will be temporarily displayed, said temporary display being coincident with the actuation of S6. Release of S6 will cause the timepiece to be respectively returned to the time-of-day, alarm setting or alternate time zone modes. Repeated actuation of S6 while the timepiece is disposed in the chronograph mode and the chronograph is running will cause the timepiece to alternately display said chronograph readings in terms of "LAP" time (time elapsed since previous actuation of S6) and "SPLIT" time (cumulative time elapsed since first actuation of S6).

When the timepiece is operating in one of the plurality of timepiece operating modes, actuation of S7 will cause the timepiece to be disposed into an operating instruction subroutine. Said operating instruction subroutine comprises operating instructions corresponding to the mode in which the timepiece was operating before it was disposed into said operating subroutine. Operation of the present invention will be discussed in further detail with reference to FIG. 4.

Figure 4:
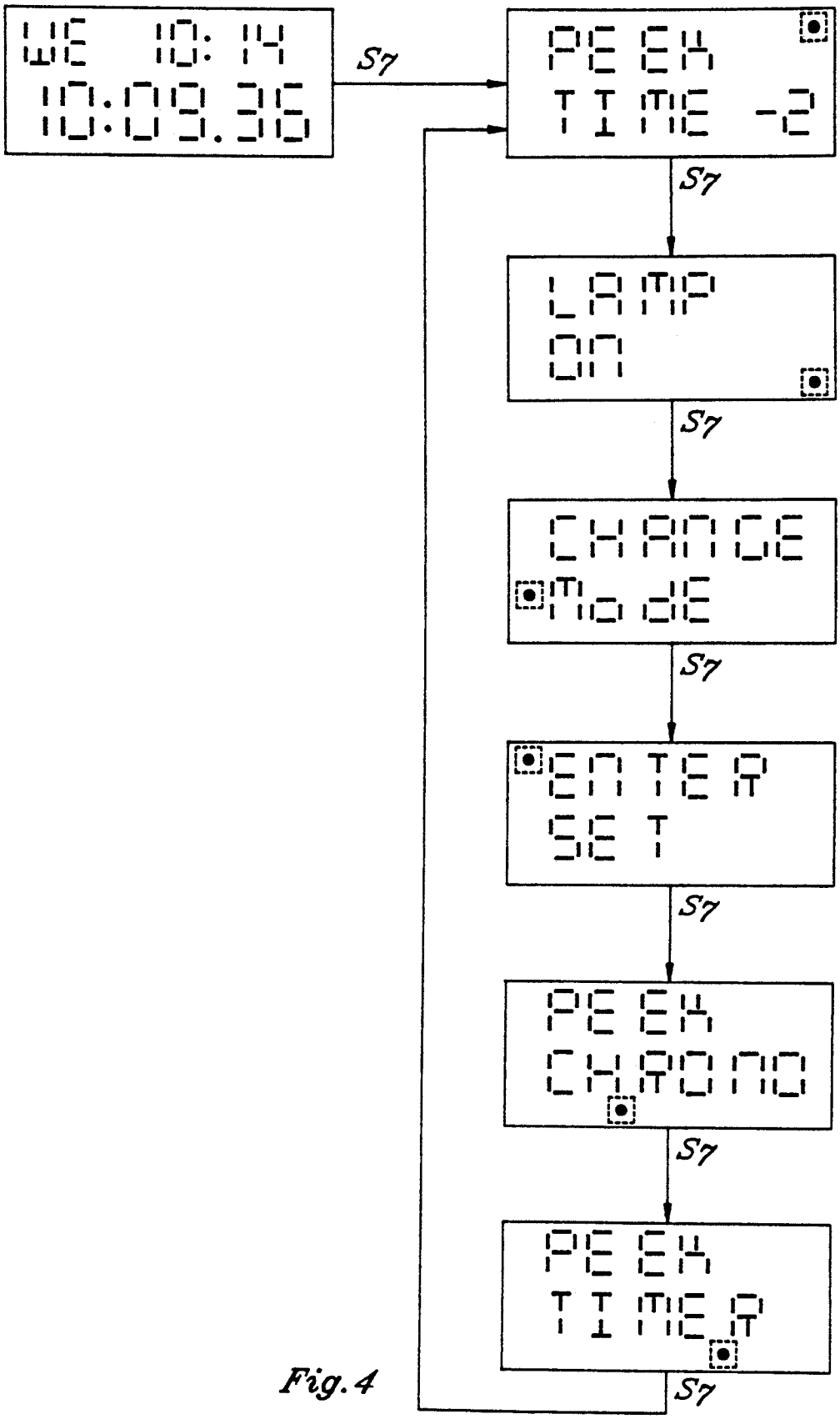
FIG. 4 is a detailed state diagram of the operation of the present invention for the time-of-day mode.

Referring to the upper left hand portion of FIG. 4, the initial state of the time-of-day mode is shown as it appears on the electrooptical display 15. Said initial state depicts a time of 10 hours, 9 minutes and 36 seconds ("10:09.36") on Wednesday, October 14. ("WE 10-14"). The right hand column of FIG. 4 shows the "state" diagram in schematic form for the time-of-day operating instruction subroutine; each rectangle representing one of a said plurality of time-of-day operating instructions as it appears on the electrooptical display 15.

In accordance with the present invention, actuation of S7 while in the time-of-day mode will cause the timepiece to be disposed into the operating instruction subroutine for the time-of-day mode. Said operating instruction subroutine comprises operating instructions for the time-of-day mode. In the preferred embodiment, said operating instructions comprise messages and indicia, wherein said indicia are displayed on a portion of said timepiece display adjacent to a one of said plurality of actuators which is adapted to perform the timepiece function corresponding to said message. However, it will be understood that said operating instructions may comprise any combination of messages and/or indicia which serve to instruct the timepiece operator on the operation of the timepiece, subject only to limitations in the timepiece display fonts and the central processing unit (CPU) of the microprocessor.

Repeated actuation of S7 will sequentially cycle the timepiece through said plurality of operating instructions with coincident display of said operating instructions on the timepiece display.

As shown in FIG. 4, a first actuation of S7 will cause the operating instruction for S1 to be displayed. In the preferred embodiment, said operating instruction comprises the message "PEEK TIME-2" and a blinking indicium adjacent to S1 (The dotted rectangle surrounding the small circle within each "state" indicates that said indicia is blinking). The combination of this message and indicium indicates to the operator that actuation of S1 while in the time-of-day mode will cause the alternate time zone, T2, to be temporarily displayed—i.e., actuation of S1 will allow the operator to "peek" at T2—said display being coincident with actuation of S1. (See also FIG. 3). Continued uninterrupted actuation of S7 will next cause the operating instruction for S2 to be displayed. In the preferred embodiment, as shown in FIG. 4, the message "LAMP ON" and a blinking indicium adjacent to S2 indicates to the operator that actuation of S2 while in the time-of-day mode will cause the lamp to be illuminated. (See also FIG. 3). Further continued uninterrupted actuation of S7 will cycle the timepiece through the plurality of operating instructions. In a first embodiment, the timepiece will be returned to the mode in which the timepiece was last operating when S7 is no longer actuated. In a second embodiment, when S7 is no longer actuated, the operating instruction subroutine is adapted to return the timepiece to the mode in which it was last operating, and is further adapted to perform the function corresponding to the message last displayed on the timepiece display before the timepiece was disposed out of the operating instruction subroutine.

Thus in said second embodiment (See e.g., FIG. 4), if, for example, an operator actuates S7 while the timepiece is disposed in the time-of-day mode, the timepiece will, in accordance with the above, be disposed into the time-of-day operating instruction subroutine. If the operator continues to actuate S7, thus cycling the timepiece through the plurality of time-of-day operating instructions, and then releases actuator S7 while the timepiece display shows "ENTER SET", the timepiece will be disposed out of the time-of-day operating instruction subroutine and into the SET subroutine of the time-of-day mode.

Figure 5:
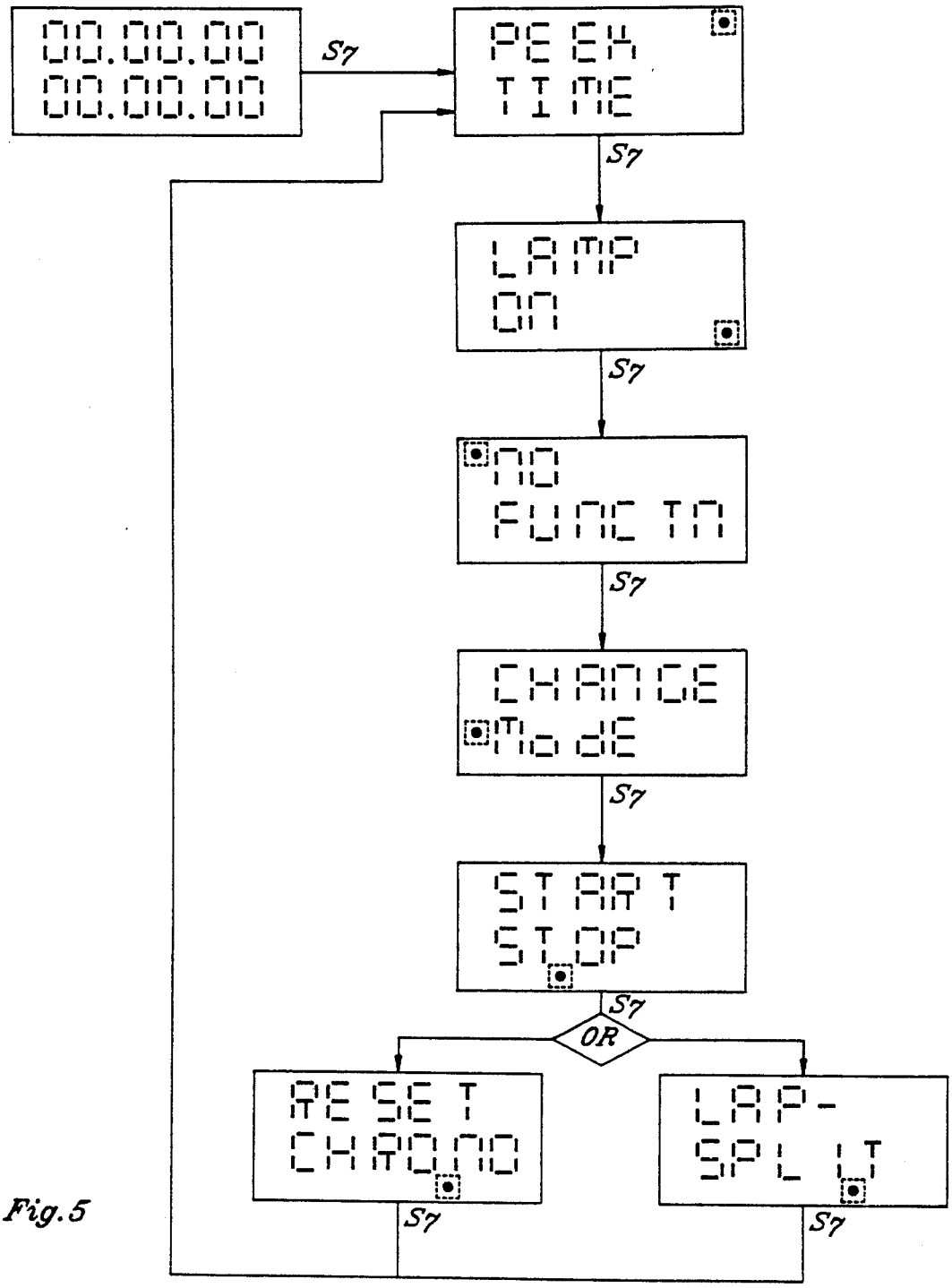
FIG. 5 is a detailed state diagram of the operation of the present invention for the chronograph mode.

Referring to FIG. 5, actuation of S7 while in the chronograph mode will cause the timepiece to be disposed into the operating instruction subroutine for the chronograph mode. Said operating instruction subroutine comprises operating instructions corresponding to the chronograph mode. Repeated actuation of S7 will sequentially cycle the timepiece through said plurality of chronograph operating instructions with coincident display of said operating instructions on the timepiece display.

The operation of the present invention for the chronograph mode is similar to that discussed above for the time-of-day mode. Referring to the upper left hand portion of FIG. 5, the initial state of the chronograph mode is shown as it appears on the electrooptical display 15. Said initial state depicts a reading of 0 hours, 0 minutes and 0 seconds ("00.00.00"). The right hand column of FIG. 5 shows the "state" diagram in schematic form for the chronograph operating instruction subroutine; each rectangle again representing one of a said plurality of chronograph operating instructions as it appears on the electrooptical display 15.

As shown in the "state" diagram of FIG. 5, a first actuation of S7 will cause the operating instruction for S1 to be displayed. In the preferred embodiment, said operating instruction comprises the message "PEEK TIME-2" and a blinking indicium adjacent to S1. The combination of this message and indicium indicates to the operator that actuation of S1 while in the chronograph mode will cause the alternate time zone, T2, to be temporarily displayed. (See also FIG. 3). Continued uninterrupted actuation of S7 will next cause the operating instruction for S2 to be displayed. In the preferred embodiment, as shown in FIG. 5, the message "LAMP ON" and a blinking indicium adjacent to S2 indicates to the operator that actuation of S2 while in the time-of-day mode will cause the lamp to be illuminated. (See also FIG. 3). Further continued uninterrupted actuation of S7 will cycle the timepiece through the plurality of operating instructions. As with the operation of the time-of-day operating instruction subroutine described above, a first embodiment provides for the timepiece to be returned to the chronograph mode when S7 is no longer actuated, while a second embodiment provides for the return of the timepiece to the chronograph mode and performance of the function corresponding to the message last displayed on the timepiece display before the timepiece was disposed out of the chronograph operating instruction subroutine, when S7 is not longer actuated.

It is known that some of said plurality of timepiece actuators are adapted to perform a plurality of functions in certain modes. Thus, in accordance with the present invention, the operating instruction subroutine for those modes in which some of the actuators are so adapted, is further adapted to display on the timepiece display, operating instructions reflecting the different operations of said actuators in those certain modes at the time the timepiece is disposed into said operating instruction subroutine.

Referring again to FIG. 3, it will be seen that when the timepiece is disposed in a chronograph mode, actuator S6 is adapted to perform differing functions depending upon the status of the mode at the time S6 is actuated. (Similarly actuator S5 is adapted to perform differing functions when the timepiece is disposed in chronograph, alarm or timer mode, again depending upon the status of the mode at the time S5 is actuated). Thus, for example, if the timepiece is disposed in chronograph mode and the chronograph is running, repeated actuation of S6 will alternately display a "LAP" and "SPLIT" reading. If, however, S6 is actuated when the timepiece is disposed in the chronograph mode and the chronograph is stopped, the chronograph will be reset and the display will show 00.00.00.

Reference to FIG. 5 shows that in the preferred embodiment, the operating instruction subroutine for the chronograph mode is adapted to alternately display operating instructions for S6 comprising the messages "RESET CHRONO" or "LAP-SPLIT" (in addition to a blinking indicium adjacent to S6), depending upon the status of the chronograph when the chronograph operating instruction subroutine is entered. Thus, if the timepiece disposed into the chronograph operating instruction subroutine when the chronograph is running, the timepiece display will show, as one of the plurality of operating instructions, "LAP-SPLIT" and a blinking indicium adjacent to actuator S6. This indicates to the timepiece operator that actuation of S6 when the chronograph is running will alternately display "LAP" and "SPLIT" readings. However if S7 is actuated when the chronograph is stopped, the timepiece display will show, as one of the plurality of operating instructions, "RESET CHRONO" and a blinking indicium adjacent to actuator S6; thus indicating to the timepiece operator that actuation of S6 when the chronograph is stopped will reset the chronograph to zero. (That is, the timepiece display will show 00.00.00).

Finally, if an actuator is not adapted to perform any function while the timepiece is disposed in a particular mode, the operating instruction subroutine for that particular mode is adapted to display an operating instruction indicating same. Referring to FIG. 5 in conjunction with FIG. 3, it will be seen that actuator S3 is not adapted to perform any function in the chronograph mode. In the preferred embodiment, the timepiece operating subroutine is adapted to display the message "NO FUNCTN" and a blinking indicium next to S3 in order to indicate to the operator that actuation of S3 will have no effect when the timepiece is the chronograph mode.

Although discussion of the operation of the present invention has been limited herein to the time-of-day and chronograph modes, it will be understood that said present invention may be expanded to include other modes, including the alarm and timer modes.

The term "mode" is used herein to designate the basic operating modes of a multimode electronic timepiece.

The term "state" is used herein to designate the various functions that the timepiece's operating program is adapted to perform while disposed in a particular mode and any coincidental display of that function's value on the timepiece's electrooptic display 15.

While there has been described what is considered to be the preferred embodiment of the invention, other modifications will become known to those skilled in the art, and it is desired to cover, in the appended claims, all such modifications as fall within the true spirit of the scope of the invention.

What is claimed is:

1. Improvement in a multimode electronic timepiece having a display, a case, a plurality of manually actuated actuators disposed about said case, and an integrated circuit programmed to keep time and to provide a plurality of modes for performing a plurality of timepiece functions, including a first and second modes, said integrated circuit being programmed to permit an operator to sequentially cycle said timepiece through said plurality of modes by selectively and repetitively actuating a first of said plurality of said actuators, wherein said improvement comprises:

operating instruction subroutine means, including a program for said integrated circuit adapted to provide first and second operating instruction subroutines, said program being responsive to selective actuation by a timepiece operator of a second of said plurality of actuators and further adapted to dispose said timepiece out of said first and second modes respectively into said first and second operating instruction subroutines in response to a first actuation of said second actuator, said first and second operating instruction subroutines respectively comprising first and second sets of operating instructions, said operating instruction subroutines being adapted to allow a timepiece operator to cycle said timepiece through said first and second sets of operating instructions in response to continuous uninterrupted actuation of said second actuator, and further repeated to display said first and second sets of operating instructions on said timepiece display, said first and second sets of operating instructions comprising messages and indicia describing the operation of said plurality of actuators when said timepiece is respectively disposed in said first and second mode, said indicia being displayed on a portion of said timepiece display adjacent to one of said plurality of actuators which is adapted to perform the timepiece function corresponding to said message.

2. The improvement according to claim 1, wherein said first and second operating instruction subroutines are further adapted to respectively dispose said timepiece out of said first and second operating instruction subroutines into said first and second mode when said second actuator is no longer actuated.

3. The improvement according to claim 1, said first and second operating instruction subroutines being further adapted to display on said timepiece display, operating instructions showing the operation of said plurality of actuators in first and second modes at the time the timepiece is respectively disposed into said first and second operating instruction subroutines.

4. The improvement according to claim 1, wherein said first and second operating instruction subroutines are adapted to respectively dispose said timepiece out of said first and second operating instruction subroutines into said first and second mode when said second actuator is no longer actuated, and further adapted to perform the timepiece function corresponding to the last message respectively displayed in said first and second operating instruction subroutine before said timepiece is disposed out of said first and second operating instruction subroutine.

5. Improvement in a multimode electronic timepiece having a display, a case, a plurality of manually actuated actuators disposed about said case, and an integrated circuit programmed to keep time and to provide a plurality of modes for performing a plurality of timepiece functions, including a first and second modes, said integrated circuit being programmed to permit an operator to sequentially cycle said timepiece through said plurality of modes by selectively and repetitively actuating a first of said plurality of said actuators, wherein said improvement comprises:

operating instruction subroutine means including a program for said integrated circuit adapted to provide first and second operating instruction subroutines, said program being responsive to selective actuation by a timepiece operator of a second of said plurality of actuators and further adapted to dispose said timepiece out of said first and second modes respectively into said first and second operating instruction subroutines in response to a first actuation of said second actuator, said first and second operating instruction subroutines respectively comprising first and second sets of operating instructions, said operating instruction subroutines being adapted to allow a timepiece operator to cycle said timepiece through said first and second sets of operating instructions in response to continuous uninterrupted actuation of a third actuator, and further adapted to display said first and second operating instructions on said timepiece display, said first and second sets of operating instructions comprising messages and indicia describing the operation of said plurality of actuators when said timepiece is respectively disposed in said first and second mode, said indicia being displayed on a portion of said timepiece display adjacent to one of said plurality of actuators which is adapted to perform the timepiece function corresponding to said message.

6. The improvement according to claim 5, wherein said first and second operating instruction subroutines are further adapted to respectively dispose said timepiece out of said first and second operating instruction subroutines into said first and second mode in response to actuation of said second actuator at any time when said timepiece is disposed in said first and second operating instruction subroutines.

7. The improvement according to claim 5, said first and second operating instruction subroutines being further adapted to display on said timepiece display, operating instructions showing the operation of said plurality of actuators in first and second modes at the time the timepiece is respectively disposed into said first and second operating instruction subroutines.

8. The improvement according to claim 6, wherein said first and second operating instruction subroutines are adapted to respectively dispose said timepiece out of said first and second operating instruction subroutines into said first and second mode when said second actuator is no longer actuated, and further adapted to perform the timepiece function corresponding to the last message respectively displayed in said first and second operating instruction subroutine before said timepiece is disposed out of said first and second operating instruction subroutine.

* * * * *

UNITED STATES PATENT AND TRADEMARK OFFICE

CERTIFICATE OF CORRECTION

PATENT NO. : 5,257,244
DATED : October 26, 1993
INVENTOR(S) : Tom Thinesen

It is certified that error appears in the above-indentified patent and that said Letters Patent is hereby corrected as shown below:

On the title page, item [75] Inventor: should read:
--[75] Inventor: Tom Thinesen--.

Signed and Sealed this

Seventeenth Day of May, 1994

Bruce Lehman

*Attest:*

BRUCE LEHMAN

*Attesting Officer*

*Commissioner of Patents and Trademarks*